US012416299B2

(12) United States Patent
Wang

(10) Patent No.: US 12,416,299 B2
(45) Date of Patent: Sep. 16, 2025

(54) MULTI-PUMP INTEGRATED MIXED FLUID DELIVERY DEVICE

(71) Applicant: XI'AN ZHENYU ELECTRON ENGINEERING CO., LTD., Shaanxi (CN)

(72) Inventor: Shaobin Wang, Shaanxi (CN)

(73) Assignee: XI'AN ZHENYU ELECTRON ENGINEERING CO., LTD., Shaanxi (CN)

( * ) Notice: Subject to any disclaimer, the term of this patent is extended or adjusted under 35 U.S.C. 154(b) by 482 days.

(21) Appl. No.: 17/938,910

(22) Filed: Sep. 6, 2022

(65) Prior Publication Data

US 2022/0412331 A1 Dec. 29, 2022

(30) Foreign Application Priority Data

Jan. 10, 2022 (CN) ..... 202210022910.4

(51) Int. Cl.

| | |
|---|---|
| ***F04B 23/06*** | (2006.01) |
| ***E21B 49/08*** | (2006.01) |
| ***F04B 9/02*** | (2006.01) |
| ***F04B 17/03*** | (2006.01) |
| ***F04B 47/06*** | (2006.01) |
| ***F04B 53/16*** | (2006.01) |
| ***F04B 53/22*** | (2006.01) |

(52) U.S. Cl.

CPC ..... *F04B 23/06* (2013.01); *E21B 49/081* (2013.01); *E21B 49/084* (2013.01); *F04B 9/02* (2013.01); *F04B 17/03* (2013.01); *F04B 47/06* (2013.01); *F04B 53/16* (2013.01); *F04B 53/22* (2013.01)

(58) Field of Classification Search

CPC .. F04B 23/06; F04B 9/02; F04B 17/03; F04B 47/06; F04B 53/16; F04B 53/22; E21B 49/081; E21B 49/084

See application file for complete search history.

(56) References Cited

U.S. PATENT DOCUMENTS

| | | | | |
|---|---|---|---|---|
| 7,162,871 | B2 * | 1/2007 | Nozaki | F04B 23/106 60/486 |
| 11,905,829 | B2 * | 2/2024 | Lu | G01V 11/002 |
| 2019/0078437 | A1 * | 3/2019 | Wang | F16H 25/2015 |

* cited by examiner

*Primary Examiner* — Bryan M Lettman

(57) ABSTRACT

A multi-pump integrated mixed fluid delivery device includes a hollow cylindrical casing, a hydraulic drive part, a power part, a sample part and a pipeline unit. The hydraulic drive part, the power part, the sample part and the pipeline unit are provided within the casing in sequence. The hydraulic drive part includes multiple hydraulic plunger pumps. The power part includes a dual-shaft motor, wherein an output shaft of the dual-shaft motor is connected with the hydraulic plunger pumps. The sample part includes a lead screw, a screw nut, a piston rod and a sample chamber, wherein one end of the lead screw is connected with another output shaft of the dual-shaft motor, the screw nut is sleeved on the lead screw, the piston rod is fixedly connected with the screw nut. The sample chamber is configured to accommodate a sample.

17 Claims, 6 Drawing Sheets

MULTI-PUMP INTEGRATED MIXED FLUID DELIVERY DEVICE

CROSS REFERENCE OF RELATED APPLICATION

The present invention claims priority under 35 U.S.C. 119(a-d) to CN 202210022910.4, filed Jan. 10, 2022.

BACKGROUND OF THE PRESENT INVENTION

Field of Invention

The present invention relates to the field of downhole petroleum measurement, and more particularly to a multi-pump integrated mixed fluid delivery device, which is able to simultaneously drive multiple pumps through a motor to output high-pressure hydraulic oil with different flow rates.

Description of Related Arts

With the development of the petroleum industry, petroleum exploration and exploration technologies are constantly updated. Formation sampling instruments have always been an important part of exploration equipment in the field of petroleum exploration. They are used to measure various data of current drilling, such as inclination and sampling.

The existing eccentering device itself requires the high-pressure hydraulic oil to be driven, such as the extension of the eccentering device. In addition, some measuring instruments installed on the eccentering device also need the high-pressure hydraulic oil to provide power. Sample cartridge for underground mud.

Generally, the existing eccentering device is only able to provide the high-pressure hydraulic oil with one flow rate (pressure), which is unable to meet the different requirements of different devices, and easily leads to power waste or shortage.

SUMMARY OF THE PRESENT INVENTION

An object of the present invention is to provide a multi-pump integrated mixed fluid delivery device, which is able to simultaneously drive multiple pumps through a motor to output high-pressure hydraulic oil with different flow rates.

Specifically, the present invention provides a multi-pump integrated mixed fluid delivery device, which comprises a hollow cylindrical casing, a hydraulic drive part, a power part, a sample part and a pipeline unit, wherein:

- the hydraulic drive part, the power part, the sample part and the pipeline unit are provided within the casing in sequence;
- the hydraulic drive part comprises multiple hydraulic plunger pumps, wherein an output end of each of the hydraulic plunger pumps is connected with a high-pressure oil output pipe, drive shafts of the plunger pumps are connected with each other through gears which are engaged with each other;
- the power part comprises a dual-shaft motor, wherein an output shaft of the dual-shaft motor, which is provided at one end of the dual-shaft motor, is connected with one of the gears;
- the sample part comprises a lead screw, a screw nut, a piston rod and a sample chamber, wherein one end of the lead screw is connected with another output shaft of the dual-shaft motor, which is provided at another end of the dual-shaft motor, the screw nut is sleeved on the lead screw, the piston rod is fixedly connected with the screw nut, and the sample chamber is configured to accommodate a sample;
- the pipeline unit comprises a cable passage and a hydraulic pipe, wherein:
  - the cable passage is configured to transmit signals, the hydraulic pipe is configured to convey hydraulic oil;
  - the pipeline unit is provided within the casing;
  - the output shaft of the dual-shaft motor drives the plunger pumps to synchronously rotate through the gears, so as to suck hydraulic oil in a mounting chamber of the each of the plunger pumps for pressurization, and then different flow rates of high-pressure hydraulic oil is outputted through the high-pressure oil output pipes respectively; the another output shaft of the dual-shaft motor drives the lead screw to rotate, so that the screw nut drives the piston rod to axially move, so as to suck an external sample into the sample chamber and deliver to a sample cylinder.

The delivery device provided by the present invention is able to simultaneously drive two plunger pumps and one piston pump to work through a dual-shaft motor, and drive three power sources. Moreover, it is able to output different flow rates of high-pressure hydraulic oil by adjusting the power of the two plunger pumps, which expands the application scope of the power. Through the gear linkage, one output shaft of the dual-shaft motor is able to drive two plunger pumps to work at the same time, which simplifies the overall connection structure and meets the space requirements for the casing to adapt to different diameters in the well. The present invention provides a variety of power options for main bases with different needs, and is convenient for installation and maintenance, which greatly improves the work efficiency.

DETAILED DESCRIPTION OF THE PREFERRED EMBODIMENT

The specific structure and implementation process of the technical solution of the present invention will be described in detail with specific embodiments and accompanying drawings as follows. The present invention is able to be applied to the downhole measuring instrument, in which the "main base" mentioned therein refers to the body on which the measuring instrument is installed. "Left" refers to the left side of the diagram while anyone faces the drawings, "right" refers to the right side of the diagram while anyone faces the drawings, and "outside world" refers to the surrounding environment of the downhole measurement location.

Figure 1:
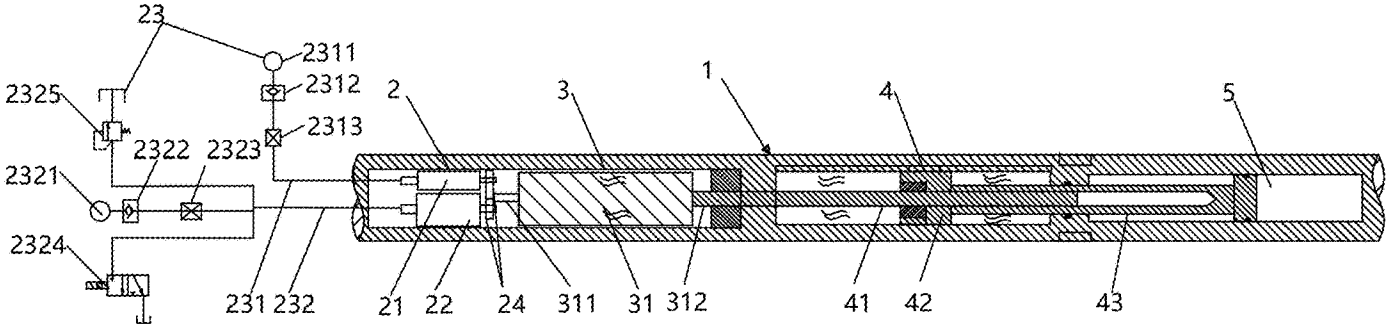
FIG. 1 is a layout diagram of a multi-pump integrated mixed fluid delivery device provided by the present invention.

As shown in FIG. 1, a multi-pump integrated mixed fluid delivery device according to a preferred embodiment of the present invention is illustrated, which comprises a hollow cylindrical casing 1, a hydraulic drive part 2, a power part 3, a sample part 4 and a pipeline unit, wherein the hydraulic drive part 2, the power part 3, the sample part 4 and the pipeline unit are provided within the casing 1 in sequence.

The hydraulic drive part 2, which is configured to deliver high-pressure hydraulic oil to an outside world, comprises a first hydraulic plunger pump 21 and a second hydraulic plunger pump 22, wherein an output end of the first hydraulic plunger pump 21 and an output end of the second hydraulic plunger pump 22 are connected with a first high-pressure oil output pipe 231 and a second high-pressure oil output pipe 232 respectively, a first drive shaft of the first hydraulic plunger pump 21 and a second drive shaft of the second hydraulic plunger pump 22 are connected with a first gear 241 and a second gear 242 respectively, the first gear 241 and the second gear 242 are engaged with each other.

The first hydraulic plunger pump 21 and the second hydraulic plunger pump 22 are able to be same in power or different in power. According to the preferred embodiment of the present invention, a flow rate of the second hydraulic plunger pump 22 is larger than that of the first hydraulic plunger pump 21. The first and second high-pressure oil output pipes 231, 232 are configured to provide power for extension and contraction of a push arm of a main base.

The power part 3 comprises a dual-shaft motor 31, wherein a first output shaft 311 and a second output shaft 312 are provided at two ends of the dual-shaft motor 31 respectively. The first output shaft 311 is connected with the first gear 241 or the second gear 242, such that when the dual-shaft motor 31 rotates, the first output shaft 311 is able to drive the first gear 241 or the second gear 242 which is engaged with the first output shaft 311 to rotate, for correspondingly driving the second gear 242 or the first gear 241 which is engaged with the first gear 241 or the second gear 242 to rotate, so as to further drive the first drive shaft of the first hydraulic plunger pump 21 and the second drive shaft of the second hydraulic plunger pump 22 to rotate, so that the first hydraulic plunger pump 21 and the second hydraulic plunger pump 22 are able to deliver high-pressure oil with different flow rates to the first and second high-pressure oil output pipes 231, 232 respectively.

The sample part 4 comprises a lead screw 41, wherein one end of the lead screw 41 is connected with the second output shaft 312 of the dual-shaft motor 31, a screw nut 42 is sleeved on the lead screw 41, a piston rod 43 is fixedly connected with the screw nut 42, a sample chamber 5 is provided at a tail portion of the sample part 4 for accommodating a sample.

The second output shaft 312 of the dual-shaft motor 31, the lead screw 41 and the piston rod 43 are axially connected with each other in sequence. When the lead screw 41 rotates, the screw nut 42 moves along an axial direction of the lead screw 41 for driving the piston rod 43 to make a reciprocating movement within the sample chamber 5.

The pipeline unit comprises a cable passage and a hydraulic pipe, wherein the cable passage is configured to transmit electrical signals on the main base to the dual-shaft motor 31, the hydraulic pipe is configured to provide various components with the hydraulic oil; the cable passage and the hydraulic pipe are provided within the casing 1.

When the delivery device provided by the present invention is fixedly connected with the main base, each interface of the delivery device is communicated with a corresponding pipeline on the main base for receiving the electrical signals and the hydraulic oil from the main base. Moreover, the first and second high-pressure oil output pipes 231, 232 are interconnected with corresponding pipelines of the main base respectively to provide the high-pressure oil with a predetermined pressure for the main base, so as to extend and contract the push arm or drive other components.

Before use, the casing 1 is firstly inserted into a corresponding position of the main base and is fixed, each interface on the casing 1 is interconnected with the corresponding interface on the main base.

During operation, the dual-shaft motor 31 starts to rotate after receiving a signal from the main base, the first output shaft 311 drives the first gear 241 or the second gear 242 to rotate, so as to simultaneously drive the first hydraulic plunger pump 21 and the second hydraulic plunger pump 22 to rotate; after rotation, the first hydraulic plunger pump 21 and the second hydraulic plunger pump 22 absorb the hydraulic oil in the installation chamber, pressurize and then output the pressurized hydraulic oil through the first and second high-pressure oil output pipes 231, 232 respectively; two output ports are provided on the first and second high-pressure oil output pipes 231, 232 respectively and are controlled to be opened or closed according to the flow requirement of the main base.

At the same time, the second output shaft 312 of the dual-shaft motor 31 drives the lead screw 41 to rotate for driving the screw nut 42 to move axially, so as to drive the piston rod 43 to move axially. The sample chamber 5 has a sample access hole (not shown in the drawings) for interconnecting with a sample cylinder for storing an external sample and the outside world. When the piston rod 43 moves within the sample chamber 5, the external sample is sucked into the sample chamber 5; and when the piston rod 43 does an opposite action, the sample in the sample chamber 5 is pressed into the sample cylinder.

According to the preferred embodiment of the present invention, the dual-shaft motor 31 is able to simultaneously drive two hydraulic plunger pumps and one piston pump to work, and to drive three power sources, and simultaneously the high-pressure hydraulic oil with different flow rates is outputted by adjusting the power of the two hydraulic plunger pumps, which expands the power application range. Through the gear linkage, one output shaft of the dual-shaft motor is able to simultaneously drive two hydraulic plunger pumps to work, which simplifies the overall connection structure and is able to meet the space requirements for the casing to adapt to different diameters in the well. According to the preferred embodiment, the present invention is able to provide a variety of power options for the main base with different needs, and is convenient for installation and maintenance, which greatly improves the work efficiency.

Figure 2:
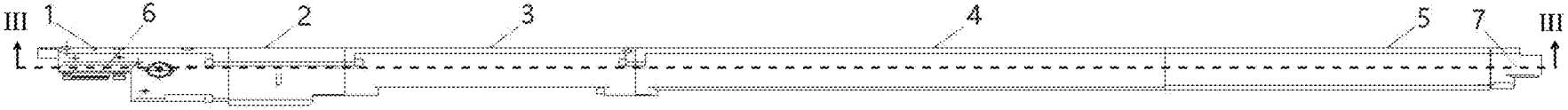
FIG. 2 is an overall schematic diagram of the multi-pump integrated mixed fluid delivery device provided by the present invention.

FIG. 2 is an overall schematic diagram of the delivery device provided by the present invention. The first and second high-pressure oil output pipes 231, 232 are provided within the hydraulic drive part 2. As shown in FIG. 2, in order to facilitate the installation and signal transmission of the delivery device, a multi-pin plug 6 is installed at one end (left end) of the casing 1, and a fixed seat 7 is installed at another end (right end) of the casing 1, an interface orientation of the multi-pin plug 6 is towards the main base, the multi-pin plug 6 has multiple plug holes; the fixed seat 7 is screwed onto a right end of the sample part 4 through screw threads; the casing 1 has two bolt holes at two ends thereof respectively. During installation, the casing 1 is overall inserted into an installation slot of the main base, an outer surface of the casing 1 is consistent with an outer surface of the main base, the multi-pin plug 6 is plugged into a multi-pin socket on the main base, the fixed seat 7 is inserted into a fixed slot on the main base, and the casing 1 is fixed with the main base through two screw rods which penetrate through the two bolt holes respectively. According to the preferred embodiment of the present invention, the delivery device is convenient for assembly and disassembly, and subsequent maintenance.

Figure 3:
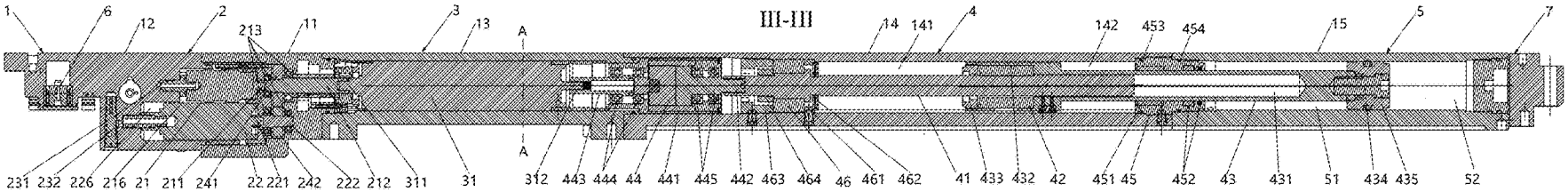
FIG. 3 is a sectional view of FIG. 2 along a central axis of a cylindrical casing.
Figure 3A:
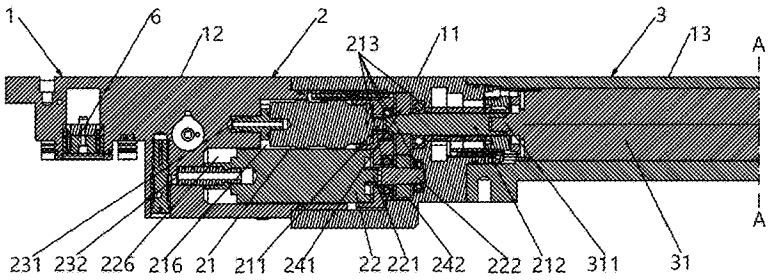
FIG. 3A is a partial view of FIG. 3.
Figure 3B:
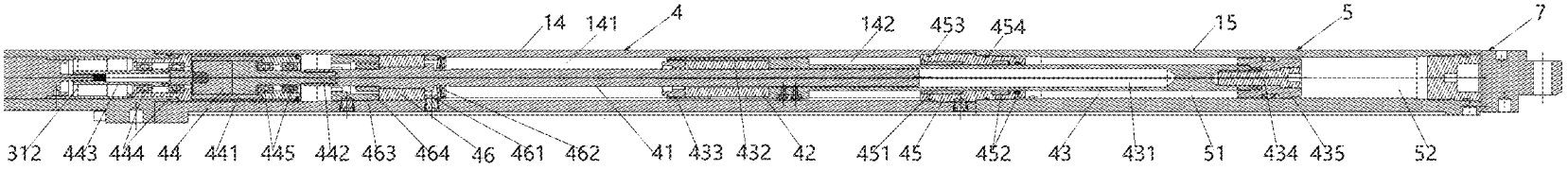
FIG. 3B is another partial view of FIG. 3.

Referring to FIG. 3, in order to facilitate the installation of various components of the delivery device, the casing 1 preferably comprises multiple sub-casings connected with each other in sequence, wherein the multiple sub-casings are a plunger sub-casing 12, a connection sub-casing 11, a motor sub-casing 13, a piston sub-casing 14 and a sample sub-casing 15 respectively. The plunger sub-casing 12 is for installing the first hydraulic plunger pump 21, the second hydraulic plunger pump 22, and the first and second high-pressure oil output pipes 231, 232. The connection sub-casing 11 is for installing connection components, namely, the first and second gears 241, 242 which are configured to connect the first and second hydraulic plunger pumps 21, 22 with the first output shaft 311 of the dual-shaft motor 31 respectively. The motor sub-casing 13 is for installing the dual-shaft motor 31. The piston sub-casing 14 is for installing the piston part 4. The sample sub-casing 15 is for defining the sample chamber 5. The sub-casings are connected with each other in a threaded manner and then are fixed by bolts.

By dividing the entire casing 1 into multiple sub-casings, the components are able to be installed within each corresponding sub-casing in advance, and then connected in a unified manner, which simplifies the installation process of the entire delivery device. In addition, when a component fails, the sub-casing corresponding to the component is able to be disassembled separately for maintenance or replacement. Therefore, the delivery device is improved in maintenance efficiency and reduced in cost.

Referring to FIG. 1, according to the preferred embodiment of the present invention, a discharge capacity of the first hydraulic plunger pump 21 is smaller than that of the second hydraulic plunger pump 22, the first and second high-pressure oil output pipes 231, 232 are independent from each other.

A first filter screen 2313 for filtering impurities, a first one-way stop valve 2312 for avoiding backflow of hydraulic oil, and a first output port 2311 for connecting with an external power are provided on the first high-pressure oil output pipe 231.

A second filter screen 2323 for filtering impurities, a second one-way stop valve 2322 for avoiding backflow of hydraulic oil, an overflow valve 2325 for oil discharge after exceeding a predetermined pressure, a solenoid valve 2324 for controlling opening and closing of the second high-pressure oil output pipe 232, and a second output port 2321 for connecting with an external power are provided on the second high-pressure oil output pipe 232.

The first and second filter screens 2313, 2323 are able to ensure the cleanliness of the outputted hydraulic oil. The first and second one-way stop valve 2312, 2322 are able to prevent the hydraulic oil from the first and second output ports 2311, 2321 from flowing backward into the first and second high-pressure oil output pipes 231, 232 respectively when the first and second hydraulic plunger pumps do not work. The overflow valve 2325 is able to ensure the stability of the pressure of the second high-pressure oil output pipe 232, and to drain excess hydraulic oil. While being energized, the solenoid valve 2324 is able to control whether the high-pressure hydraulic oil is outputted to the outside world, and at the same time, to return the high-pressure hydraulic oil discharged from the second hydraulic plunger pump 22 to an oil return pipeline.

As shown in FIG. 3, in order to shorten an overall length of the delivery device, the first and second hydraulic plunger pumps 21, 22 are set within the plunger sub-casing 12 in parallel, the first drive shaft 211 of the first hydraulic plunger pump 21 and a second drive shaft 221 of the second hydraulic plunger pump 22 are provided at a same direction, namely, a right side of the first hydraulic plunger pump 21 and a right side of the second hydraulic plunger pump 22 respectively, or a left side of the first hydraulic plunger pump 21 and a left side of the second hydraulic plunger pump 22 respectively; the first and second gears 241, 242 are directly installed on the first and second drive shafts 211, 221 respectively and are engaged with each other.

When the first and second drive shafts 211, 221 are not long enough, a first transmission shaft and a second transmission shaft for extension are able to be installed between the first and second hydraulic plunger pumps 21, 22 and the dual-shaft motor 31 respectively; and then the first and second gears 241, 242 are installed on the first and second transmission shafts respectively. According to the preferred embodiment, the first output shaft 311 of the dual-shaft motor 31 is connected with the first drive shaft 211 of the first hydraulic plunger pump 21 through the first transmission shaft 212, the first gear 241 is fixedly installed on an external surface of the first transmission shaft 212.

To correspond to the position of the first gear 241, the second drive shaft 221 of the second hydraulic plunger pump 22 is connected with the second transmission shaft 222, the second gear 242 is fixedly installed on an external surface of the second transmission shaft 222, external teeth of the second gear 242 are engaged with external teeth of the first gear 241. The first transmission shaft 212 is longer than the second transmission shaft 222, and a diameter of the first gear 241 is larger than that of the second gear 242.

Gears with different diameters are able to selected according to installation positions of the first and second hydraulic plunger pumps 21, 22, and moreover, the rotating speed of the first and second hydraulic plunger pumps 21, 22 is able to be controlled through the gears with different diameters. To limit positions of the first and second gears 241, 242, four first bearings 213 for limit and support are installed at two sides of the first and second gears 241, 242.

While working, the first output shaft 311 of the dual-shaft motor 31 drives the first transmission shaft 212 to rotate, so as to further drive the first drive shaft 211 of the first hydraulic plunger pump 21 to rotate. When the first transmission shaft 212 rotates, the first gear 241 fixed on the first transmission shaft 212 simultaneously drives the second gear 242 which is engaged with the first gear 241 to rotate, so that the second hydraulic plunger pump 22 is indirectly driven to rotate through the second transmission shaft 222 and the second drive shaft 221, thereby achieving that the dual-shaft motor 31 simultaneously drives the first and second hydraulic plunger pumps 21, 22 to rotate through the first output shaft 311 of the dual-shaft motor 31.

Further, the first and second hydraulic plunger pumps 21, 22 are installed within a first plunger chamber 216 and a second plunger chamber 226 of the plunger sub-casing 12 through external threads respectively; the first and second plunger chambers 216, 226, which are provided in parallel and interconnected with each other, are full of hydraulic oil. When the first and second hydraulic plunger pumps 21, 22 work, the normal-pressure hydraulic oil in the first and second plunger chambers 216, 226 is directly sucked into the first and second hydraulic plunger pumps 21, 22 respectively, and then is pressurized, and then the pressurized hydraulic oil is outputted through the first and second high-pressure oil output pipes 231, 232 respectively. The first and second plunger chambers 216, 226 are interconnected with the oil return pipeline of the delivery device for recycling the hydraulic oil. Moreover, in spite that the first and second plunger chambers 216, 226 are interconnected with each other, the first and second high-pressure oil output pipes 231, 232, which are connected with the first and second plunger chambers 216, 226 respectively, are independent from each other.

Figure 4:
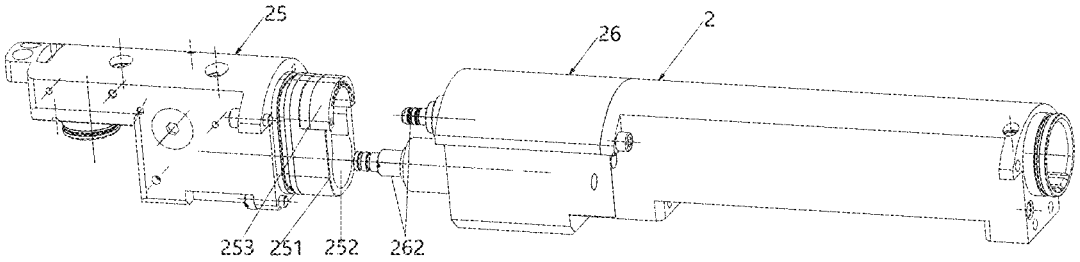
FIG. 4 is a schematic diagram of a plugging manner of a plunger sub-casing of the multi-pump integrated mixed fluid delivery device provided by the present invention.
Figure 5:
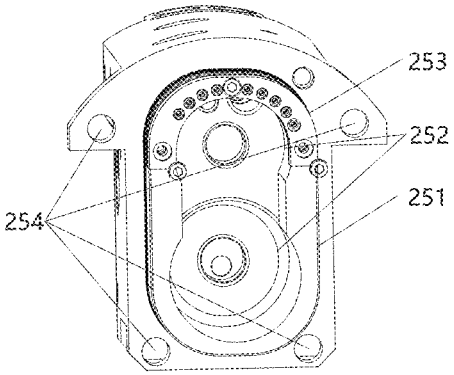
FIG. 5 is a structurally schematic diagram of a first oil pipe module shown in FIG. 4.
Figure 6:
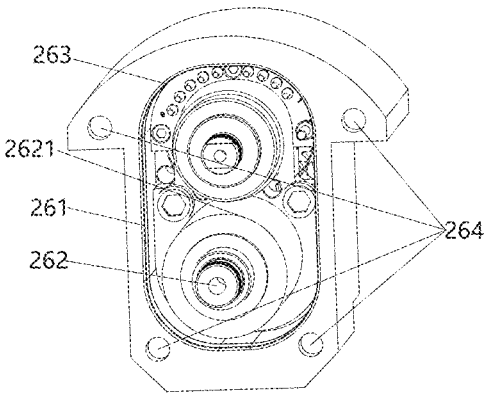
FIG. 6 is a structurally schematic diagram of a first pump module shown in FIG. 4.

As shown in FIGS. 4-6, a connection manner between the first and second hydraulic plunger pumps and the first and second high-pressure oil output pipes is illustrated. In the plunger sub-casing 12, the first and second hydraulic plunger pumps 21, 22 are connected with the first and second high-pressure oil output pipes 231, 232 respectively through a plug-in structure. The plug-in structure comprises a first oil pipe module 25 with the first and second high-pressure oil output pipes 231, 232, and a first pump module 26 with the first and second hydraulic plunger pumps 21, 22.

A rectangular convex structure 251, which is provided at a connection end of the first oil pipe module 25, has two first stepped insertion holes 252 which are interconnected with the first and second high-pressure oil output pipes 231, 232 respectively. A distance is provided between an external side of the rectangular convex structure 251 and an edge of each of the first stepped insertion holes 252, in such a manner that the rectangular convex structure 251 has a corresponding width. A first multi-pin socket 253, which is fixed on an upper portion of the rectangular convex structure 251 through studs. Multiple socket holes are evenly distributed in a semi-arc shape based on a shape of the upper portion of the rectangular convex structure 251.

A rectangular concave structure 261 is provided at an output end of the first pump module 26 (which is corresponding to the first oil pipe module 25). An inner diameter of the rectangular concave structure 261 is equal to an outer diameter of the rectangular convex structure 251, such that the rectangular convex structure 251 is fully inserted into the rectangular concave structure 261. A first multi-pin plug 263 which matches the first multi-pin socket 253 is installed on the rectangular concave structure 261. Two oil pipe joints 262 are provided within the rectangular concave structure 261 and match the first stepped insertion holes 252 respectively. Two cylindrical fixed columns 2621 are sleeved on the oil pipe joints 262 respectively, so that after the oil pipe joints 262 are inserted into the first stepped insertion holes 252, the fixed columns 2621 are engaged with the first stepped insertion holes 252 for sealing, so as to prevent the oil pipe joints 262 from radial movement. Furthermore, the fixed columns 2621 are also able to play the role of positioning to avoid the relative rotation of the first oil pipe module 25 and the first pump module 26 after insertion.

The first oil pipe module 25 has multiple first bolt holes 254 at a periphery thereof. The first pump module 26 has multiple second bolt holes 264, which match the first bolt holes 254 respectively at a periphery thereof. When the first oil pipe module 25 and the first pump module 26 are plugged with each other, the rectangular convex structure 251 is engaged with the rectangular concave structure 261, the oil pipe joints 262 are inserted into the first stepped insertion holes 252 respectively, multiple pins of the first multi-pin plug 263 are inserted into the multiple socket holes of the first multi-pin socket 253 respectively, and then bolts pass through the first bolt holes 254 and the second bolt holes 264 which are aligned after insertion to fix the first oil pipe module 25 with the first pump module 26; and then the first oil pipe module 25 and the first pump module 26 are fixed within the plunger sub-casing 12, or directly form the plunger sub-casing 12.

According to the preferred embodiment of the present invention, the first multi-pin socket 253 and the first multi-pin plug 263 may be an independent module respectively; the rectangular convex structure 251 and the rectangular concave frame 261 have two openings with the same shape respectively, and the first multi-pin socket 253 and the first multi-pin plug 263 are fixed in the two openings by bolts respectively.

The plug-in structure of this embodiment is suitable for the case where only one measuring instrument is installed on the main base, that is, only one measuring instrument is installed on the main base, or the delivery device is located at the tail of the main base, and there is no need to provide functions other than high-pressure oil and sample collection for other measuring instrument.

Figure 7:
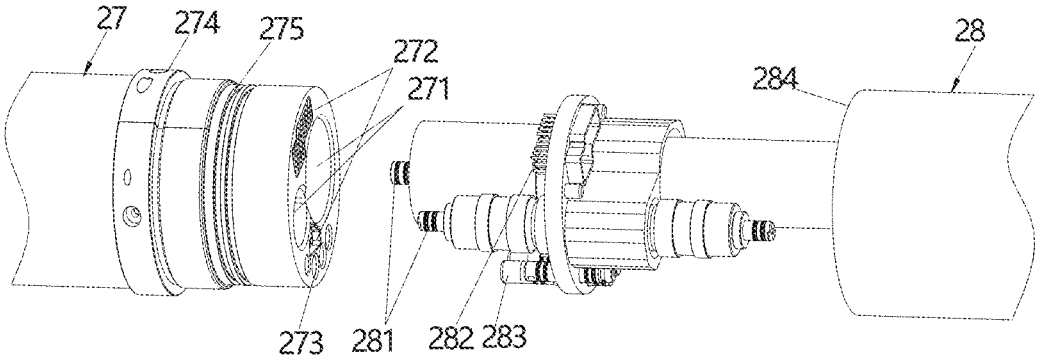
FIG. 7 is a schematic diagram of another plugging manner of the plunger sub-casing of the multi-pump integrated mixed fluid delivery device provided by the present invention.
Figure 8:
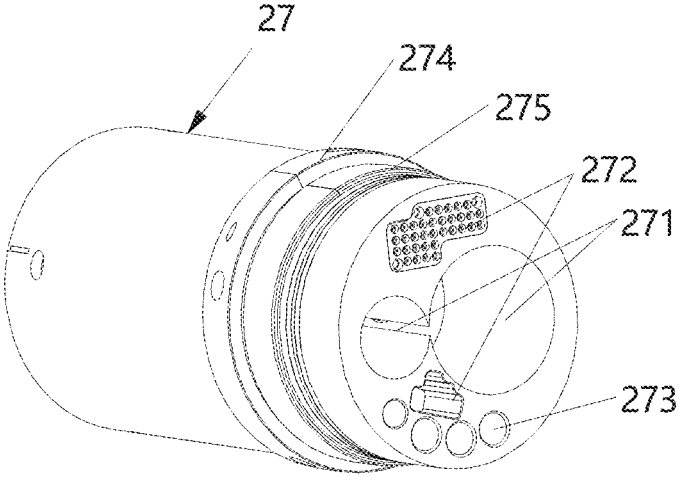
FIG. 8 is a structurally schematic diagram of a second oil pipe module shown in FIG. 7.
Figure 9:
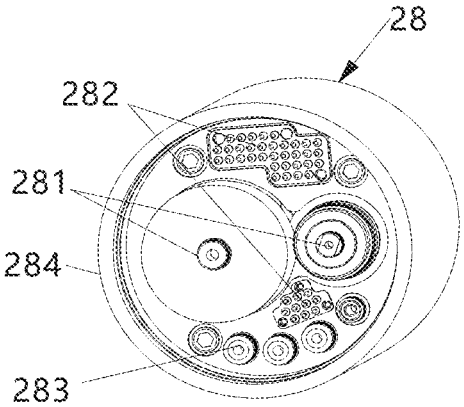
FIG. 9 is a structurally schematic diagram of a second pump module shown in FIG. 7.

As shown in FIGS. 7 to 8, another connection manner between the first and second hydraulic plunger pumps, and the first and second high-pressure oil output pipes is illustrated. The first and second hydraulic plunger pumps 21, 22 are connected with the first and second high-pressure oil output pipes 231, 232 respectively through a screw structure. The screw structure comprises a second oil pipe module 27 with the first and second high-pressure oil output oil pipes 231, 232, and a second pump module 28 with the first and second hydraulic plunger pumps 21, 22. The second oil pipe module 27 and the second pump module 28 are cylindrical. Two second stepped insertion holes 271, a second multi-pin socket 272 for signal output, and multiple delivery ports 273 for delivering the hydraulic oil or the sample are provided at a connection end of the second oil pipe module 27.

Preferably, the two stepped insertion holes 271 are interconnected with the first and second high-pressure oil output pipes 231, 232 respectively. The second multi-pin socket 272 comprises two multi-pin sub-sockets which are installed on the connection end of the second oil pipe module 27 through slots on the second oil pipe module 27. The multiple delivery ports 273 are interconnected with pipelines passing through the exterior of the second oil pipe module 27 respectively. The pipelines here refer to the passages located inside the delivery device to delivery hydraulic oil or samples for another connected device, and are not passages serving or serving only the delivery device provided by the present invention.

Two stepped insertion columns 281 for matching the two second stepped insertion holes 271, a second multi-pin plug 282 for matching the second multi-pin socket 272, and multiple delivery plugs 283 for matching the multiple delivery ports 273 respectively are provided at an output end of the second pump module 28.

A threaded sleeve 274 is provided at an external surface of the connection end of the second oil pipe module 27 for fixedly connecting the second oil pipe module 27 with the second pump module 28 after insertion.

During installation, the second oil pipe module 27 and the second pump module 28 are plugged with each other in an end-to-end manner, the two stepped insertion columns 281 are plugged into the two second stepped insertion holes 271 respectively, the two second multi-pin plugs 282 are plugged into the second multi-pin socket 272, and the multiple delivery plugs 283 are plugged into the multiple delivery ports 273 respectively.

Multiple first sealing rings 275 are provided at the external surface of the connection end of the second oil pipe module 27, an annular protrusion 284 is provided at an outer circumference of a connection end of the second pump module 28, an external surface of the annular protrusion 284 has multiple external threads. After the second oil pipe module 27 and the second pump module 28 are plugged with each other, an internal surface of the annular protrusion 284 is sleeved on the external surface of the connection end of the second oil pipe module 27, and are in sealing contact with the multiple first sealing rings 275. The second oil pipe module 27 and the second pump module 28 are connected with each other by the threaded sleeve 274 through the external threads of the annular protrusion 284, and then are fixed with each other by bolts.

According to the preferred embodiment of the present invention, the stepped insertion columns 281 and the multiple delivery plugs 283 are capable of positioning after installation, so as to prevent the second oil delivery module 27 and the second pump module 28 which are connected with each other from relatively rotating. The multiple delivery plugs 283 and the multiple delivery ports 273 form a delivery channel for interconnecting with another device, so as to provide corresponding hydraulic oil or sample for the another device.

The screw structure provided by the present invention is suitable for installing multiple measuring instruments on the main base at the same time. Through the delivery channel, the multiple measuring instruments are able to share a set of hydraulic oil output pipes so that it is not necessary to install a corresponding transmission channel for every measuring instrument, which greatly reduces the diameter of the entire main base and simplifies the design of the main base.

Through the segmented installation structure, each component is able to be disassembled independently, which further improves the maintenance efficiency and reduces the overall cost.

Preferably, a reducer 44 is provided between the second output shaft 312 of the dual-shaft motor 31 and the lead screw 41, the reducer 44 is installed at an end portion of the piston sub-casing 14 through a mounting base 441, an output shaft 442 of the reducer 44 is connected with an end portion of the lead screw 41, an external surface of the mounting base 441 is in contact with an internal surface of the piston sub-casing 14, and the mounting base 441 is fixed with the piston sub-casing 14 through bolts.

In order to facilitate the connection between the second output shaft 312 of the dual-shaft motor 31 and the reducer 44, a connection shaft 443 for extending a connection distance is provided between the second output shaft 312 and the reducer 44. The connection shaft 443 extends into the mounting base 441 and is connected with the reducer 44, two support bearings 444 are installed on one end portion of the connection shaft 443 which extends into the mounting base 441 for supporting and limiting the connection shaft 443. Similarly, two second bearings 445 for support and limit are installed on the output shaft 442 of the reducer 44. The reducer 44 is able to adjust a rotating speed of the lead screw 41 and improve a suction efficiency of the piston rod 43.

Referring to FIG. 3, preferably, an isolation sleeve 45, which is provided in a middle portion of the piston rod 43, is connected with the piston sub-casing 14 and the sample sub-casing 15 through external threads of the isolation sleeve 45 respectively, and then is fixed with the piston sub-casing 14 and the sample sub-casing 15 through bolts which pass through the piston sub-casing 14 and the sample sub-casing 15. One end of the isolation sleeve 45 close to the screw nut 42 has an inner annular groove. A metal ring 451, which contacts the external surface of the piston rod 43, is provided within the inner annular groove through interference fit. A movable sealing ring 452 is provided within an inner hole which is away from the screw nut 42 and in contact with the piston rod 43. Two sealing grooves 453, which match the piston sub-casing 14 and the sample sub-casing 15 respectively, are provided on an external surface of the isolation sleeve 45. Two second sealing rings 454 are provided within the sealing grooves 453 respectively.

According to the preferred embodiment of the present invention, the isolation sleeve 45 not only serves as a connecting piece for connecting the piston sub-casing 14 with the sample sub-casing 15, but also serves as a spacer between the screw nut 42 and the sample chamber 5. There is sliding friction between the metal ring 451 and the piston rod 43. The metal ring 451 is relatively high in hardness, so its own wear loss is able to be prolonged and the piston rod 43 is prevented from directly wearing the isolation sleeve 45. At the same time, due to the rigid support effect, the metal ring 451 is also able to reduce the wear of the movable sealing ring 452, so as to reduce the replacement frequency thereof. Multiple movable sealing rings 452 are able to be provided as required. According to the preferred embodiment of the present invention, there are two movable sealing rings 452.

After being isolated by the isolation sleeve 45, a hydraulic oil chamber is formed in the piston sub-casing 14 for the movement of the screw nut 42, the sample chamber 5 is provided within the sample sub-casing 15, and an oil pressure of the hydraulic oil chamber is normal pressure.

Further, an accommodating passage 431 for allowing the lead screw 41 to enter is provided within the piston rod 43, the piston rod 43 is sleeved on the screw nut 42 through an opening 432 of the accommodating passage 431. A lock ring 433 for locking the screw nut 42 within an interior of the accommodating passage 431 is provided at the opening 432. An external surface of the opening 432 is in contact with the internal surface of the piston sub-casing 14. A piston 435, which has a diameter as same as an inner diameter of the piston sub-casing 14, is fixed at one end of the piston rod 43 away from the screw nut 42. The piston 435 divides the sample chamber 5 into a left chamber 51 and a right chamber 52, the left chamber 51 and the right chamber 52 are interconnected with the outside world through pipelines respectively, and simultaneously are interconnected with the sample cylinder of the main base.

The accommodating passage 431 of the piston rod 43 is not in contact with the lead screw 41 for avoiding the wear on the threads of the lead screw 41. The piston 435 is able to be made of metal or flexible materials. An axial through-hole is provided in a middle of the piston 435. The piston 435 is fixed with an end portion of the piston rod 43 through a screw 434 which passes through the axial through-hole. When the piston 435 is made of metal, there are multiple sealing rings on the external surface of the piston 435 which are in contact with the internal surface of the sample chamber 5.

While working, the dual-shaft motor 31 drives the lead screw 41, the screw nut 42 and the piston rod 43 to synchronously rotate. When the piston 435 moves rightwards, the right chamber 52 is squeezed to deliver the sample in the right chamber 52 to the sample cylinder; and at this time, due to the right movement of the piston 435, a suction force is generated in the left chamber 51 for sucking the external sample (such as mud) through a channel. When the piston 435 moves to the rightmost end of the right chamber 52, the squeeze signal is fed back to the dual-shaft motor 31 (the forward time and the reverse time of the dual-shaft motor 31 are able to be preset according to the stroke of the piston 435), the dual-shaft motor 31 begins to rotate reversely for driving the piston 435 to move towards the left chamber 51; and the working way at this time is opposite to that when the piston moves towards the right chamber 52. Under the squeeze of the piston 435, the sample in the left chamber 51 is delivered to the sample cylinder, and the external sample is sucked into the right chamber 52 through a channel. When the piston 435 moves to the leftmost end of the left chamber 51, the piston 435 reverses again and moves towards the right chamber 52. The process loops until the sample cylinder completes the collection.

In actual use, the small volume of the sample chamber 5 and the large volume of the sample cylinder, the difference between the two may be 10-30 times. Therefore, multiple forward and reverse cycles of the dual-shaft motor 31 are required to meet the collection needs of the sample cylinder. One-way valves are provided on the channels connecting the left chamber 51 and the right chamber 52 with the outside world and the sample cylinder respectively, so as to prevent the reverse flow of the sample in the left chamber 51 and the right chamber 52 when the piston 435 moves leftwards and rightwards.

Further, a limit bearing 46 is provided at one end of the lead screw 41 which is connected with the reducer 44, a baffle ring 461 and a disc spring 462 are provided at one side of the limit bearing 46 which is away from the reducer 44, a fixed sleeve 463 and a lock nut 464 are provided at another side of the limit bearing 46 which is close to the reducer 44, and the lock nut 464 is screwed on the lead screw 41 for fixing the limit bearing 46.

The limit bearing 46 is able to limit the lead screw 41 to an axial line thereof, the baffle ring 461 and the fixed sleeve 463 are able to limit the position of the limit bearing 46 for avoiding the axial movement of the limit bearing 46. A step protruding toward an axial center is provided on the inner surface of the piston sub-casing 14 where the limit bearing 46 is installed. The baffle ring 461 is blocked by the step. After installation, the fixed sleeve 463 is fixed by bolts passing through the piston sub-casing 14.

While working, the piston rod 41 moves leftwards, the disc spring 462 is squeezed to produce a thrust, the thrust is applied to the opening 432 of the piston rod 43 for preventing the opening 432 of the piston rod 43 from being seized with the lead screw 41.

According to the preferred embodiment of the present invention, the external surface of the opening 432 of the accommodating passage 431 is as same as an inner diameter of the piston sub-casing 14. A hydraulic oil chamber body of the piston sub-casing 14 is divided into a left hydraulic oil chamber 141 and a right hydraulic oil chamber 142.

The hydraulic oil in the left hydraulic oil chamber 141 and the right hydraulic oil chamber 142 is normal-pressure oil, which does not output hydraulic power to the outside world, but is only used to keep the pressure in the hydraulic oil chamber at the same level as the outside pressure, so as to avoid the deformation of the piston sub-casing 14. The left hydraulic oil chamber 141 is interconnected with the right hydraulic oil chamber 142 through a channel. When the screw nut 42 moves leftwards and rightwards, the hydraulic oil in the left hydraulic oil chamber 141 and the hydraulic oil in the right hydraulic oil chamber 14 circulate with each other.

Figure 10:
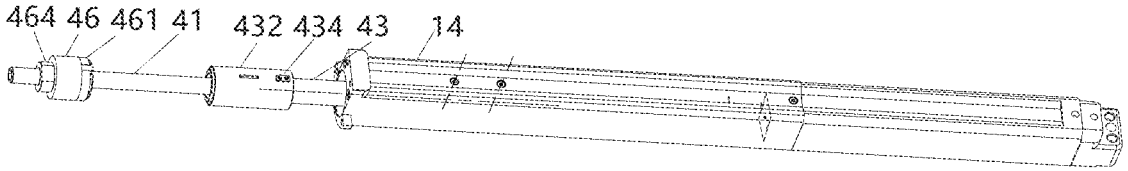
FIG. 10 is a structurally schematic diagram of a positioning key.
Figure 11:
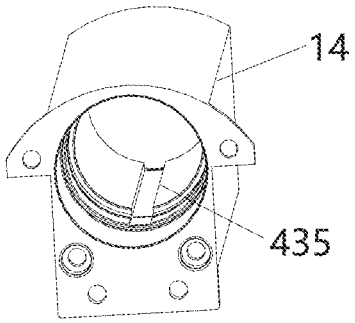
FIG. 11 is a structurally schematic diagram of a feather keyway which matches the positioning key shown in FIG. 10.

Referring to FIGS. 10 and 11, in order to limit the piston rod 43 only to move axially, a convex positioning key 434 is provided on the external surface of the opening 432 of the piston rod 43. A feather keyway 435 matching the positioning key 434 is provided within the piston sub-casing 14. The feather keyway 435 extends along an axial direction of the piston sub-casing 14. A length of the feather keyway 435 is corresponding to a movable distance of the screw nut 42. The positioning key 434 is fixed on the external surface of the opening 432 through a screw which simultaneously passes through the opening 432 and the screw nut 42. Moreover, the feather keyway 435 is able to act as a channel for interconnecting the left hydraulic oil chamber 141 and the right hydraulic oil chamber 142, that is, a width of the feather keyway 435 is larger than a width of the positioning key 434, so as to leave enough space for hydraulic oil to pass through.

Figure 12:
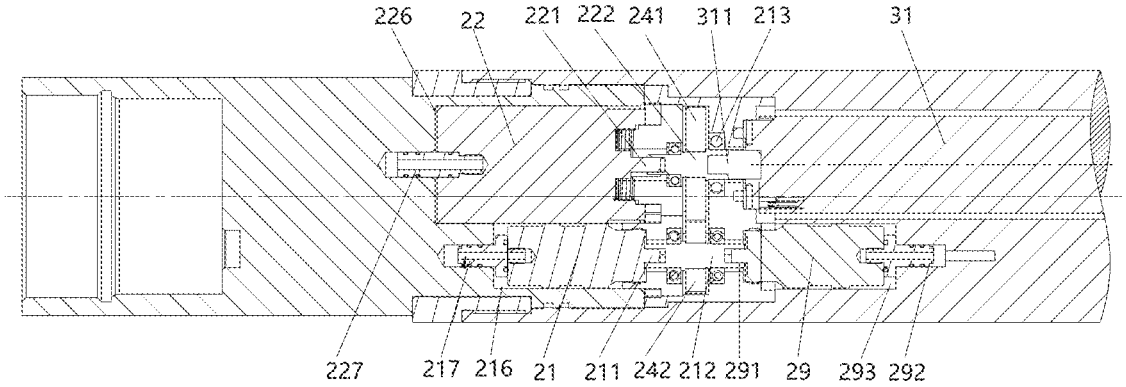
FIG. 12 shows a connection relationship among three pumps.

Referring to FIG. 12, based on the above-mentioned technical solution that a dual-shaft motor drives two hydraulic plunger pumps, another technical solution that a dual-shaft motor drives three hydraulic plunger pumps is proposed. The above-mentioned technical solution and the present technical solution are basically same in structure, the difference is that in the technical solution of the three hydraulic plunger pumps, two hydraulic plunger pumps with low flow rate are provided at two sides of the transmission shaft with low flow rate respectively, which is explained in detail as follows.

The first hydraulic plunger pump 21 and the second hydraulic plunger pump 22 are installed within the plunger sub-casing 12 in parallel, the first output shaft 211 of the first hydraulic plunger pump 21 and the second output shaft of the second hydraulic plunger pump 22 are provided in the same direction, the first gear 241 and the second gear 242 are directly installed on the first drive shaft 211 of the first plunger pump 21 and the second drive shaft 221 of the second plunger pump 22 respectively, and engaged with each other.

The first output shaft 311 of the dual-shaft motor 31 is connected with the second drive shaft 221 of the second plunger pump 22 through the second transmission shaft 222, and the first gear 241 is fixedly installed on the external surface of the second transmission shaft 222.

To match the first gear 241, the first drive shaft 211 of the first hydraulic plunger pump 21 is connected with one end of the first transmission shaft 212. The second gear 242 is fixedly installed on the external surface of the first transmission shaft 212. The external teeth of the second gear 242 are engaged with the external teeth of the first gear 241. Another end of the first transmission shaft 212 is connected with a third drive shaft 291 of the third hydraulic plunger pump 29.

Four first bearings 213 are provided at two sides of the first gear 241 and the second gear 242 respectively for limit and support.

While working, the first output shaft 311 of the dual-shaft motor 31 drives the second transmission shaft 222 to rotate, so as to further drive the second drive shaft 221 of the second hydraulic plunger pump 22 to rotate. When the second transmission shaft 222 rotates, the first gear 241 fixed on the second transmission shaft 222 synchronously drives the second gear 242 to rotate, so as to indirectly synchronously drive the second hydraulic plunger pump and the third hydraulic plunger pump through the first transmission shaft 212 to work, thereby achieving that the dual-shaft motor 31 drives the first hydraulic plunger pump 21, the second hydraulic plunger pump 22 and the third hydraulic plunger pump 29 in sequence to simultaneously work. The characteristics of the third hydraulic plunger pump 29 are as same as those of the first and second hydraulic plunger pumps 21, 22. The third hydraulic plunger pump 29 outputs the high-pressure hydraulic oil with a certain flow rate. The three hydraulic plunger pumps are able to output the high-pressure hydraulic oil with same flow rate, or the high-pressure hydraulic oil with various flow rates. Each device that needs pressure is able to be connected to the corresponding output port as needed, and the high-pressure oil output pipe that is not used is able to be closed through a valve.

The first hydraulic plunger pump 21, the second hydraulic plunger pump 22 and the third hydraulic plunger pump 29 are installed within a first plunger chamber 216, a second plunger chamber 226 and a third plunger chamber 293 of the plunger sub-casing 12 respectively through external threads. The first and second plunger chamber 216, 226 are provided in parallel and interconnected with each other. The third plunger chamber 293 is opposite to and interconnected with the first plunger chamber 216. The first, second and third plunger chambers 216, 226, 293 are full of hydraulic oil. When the first, second and third hydraulic plunger pumps 21, 22, 29 work, the normal-pressure hydraulic oil in the first, second and third plunger chambers 216, 226, 293 is sucked thereinto and then pressurized, and then is outputted by the first high-pressure oil output pipe 231, the second high-pressure oil output pipe 232, and a third high-pressure oil output pipe 292. The first, second and third plunger chambers 216, 226, 293 are interconnected with the oil return pipeline of the delivery device respectively to realize the recycling of hydraulic oil. Moreover, in spite that the first, second and third plunger chambers 216, 226, 293 are interconnected with each other, the first, second and third high-pressure oil output pipes 231, 232, 292 are independent from each other.

By now, those skilled in the art will recognize that although various exemplary embodiments of the present invention have been shown and described in detail herein, other variations or modifications consistent with the principles of the present invention may be determined directly or derived from the present disclosure without departing from the spirit and scope of the present invention. Therefore, the scope of the present invention should be understood and deemed to cover all such other variations or modifications.

What is claimed is:

1. A multi-pump integrated mixed fluid delivery device, which comprises a hollow cylindrical casing, a hydraulic drive part, a power part, a sample part and a pipeline unit, wherein:

the hydraulic drive part, the power part, the sample part and the pipeline unit are provided within the casing in sequence;

the hydraulic drive part comprises multiple hydraulic plunger pumps, wherein an output end of each of the plunger pumps is connected with an oil output pipe, drive shafts of the hydraulic plunger pumps are connected with each other through gears which are engaged with each other;

the power part comprises a dual-shaft motor, wherein a first output shaft of the dual-shaft motor, which is provided at one end of the dual-shaft motor, is connected with one of the gears;

the sample part comprises a lead screw, a screw nut, a piston rod and a sample chamber, wherein one end of the lead screw is connected with a second output shaft of the dual-shaft motor, which is provided at another end of the dual-shaft motor, the screw nut is sleeved on the lead screw, the piston rod is fixedly connected with the screw nut, and the sample chamber is configured to accommodate a sample;

the pipeline unit comprises a cable passage and multiple oil output pipes comprising the oil output pipe, wherein:

the cable passage is configured to transmit signals, the oil output pipes are configured to convey hydraulic oil;

the pipeline unit is provided within a mounting base of the hydraulic drive part, the power part and the sample part;

the first output shaft of the dual-shaft motor drives the hydraulic plunger pumps to synchronously rotate through the gears, so as to suck hydraulic oil in a mounting chamber of each of the multiple hydraulic plunger pumps for pressurization, and then different flow rates of pressurized hydraulic oil are outputted through the oil output pipes respectively; the second output shaft of the dual-shaft motor drives the lead screw to rotate, so that the screw nut drives the piston rod to axially move, so as to suck an external sample into the sample chamber and deliver to a sample cylinder.

2. The multi-pump integrated mixed fluid delivery device according to claim 1, wherein there are two hydraulic plunger pumps which are a first hydraulic plunger pump and a second hydraulic plunger pump, a first oil output pipe and a second oil output pipe are connected with an output end of the first hydraulic plunger pump and an output end of the second hydraulic plunger pump respectively, a first gear of the gears is installed on a first drive shaft of the first hydraulic plunger pump, a second gear of the gears is installed on a second drive shaft of the second hydraulic plunger pump, the first gear of the gears is engaged with the second gear of the gears.

3. The multi-pump integrated mixed fluid delivery device according to claim 1, wherein a multi-pin plug is installed at one end of the casing, and a fixed seat is installed at another end of the casing, the casing is connected and fixed with a main base connecting the cable passage having cables therein and oil pipes comprising the oil outlet pipes through the multi-pin plug and the fixed seat.

4. The multi-pump integrated mixed fluid delivery device according to claim 2, wherein:

the casing comprises multiple sub-casings connected with each other in sequence;

the multiple sub-casings are a plunger sub-casing, a connection sub-casing, a motor sub-casing, a piston sub-casing and a sample sub-casing respectively;

the plunger sub-casing is for installing the first hydraulic plunger pump and the second hydraulic plunger pump;

the connection sub-casing is for installing the first and second gears which are configured to connect the first and second hydraulic plunger pumps with the output shaft of the dual-shaft motor respectively;

the motor sub-casing is for installing the dual-shaft motor;

the piston sub-casing is for installing the piston part;

the sample sub-casing is for defining the sample chamber.

5. The multi-pump integrated mixed fluid delivery device according to claim 4, wherein a discharge capacity of the first hydraulic plunger pump is smaller than that of the second hydraulic plunger pump, the first and second oil output pipes are independent from each other.

6. The multi-pump integrated mixed fluid delivery device according to claim 4, wherein:

in the plunger sub-casing, the first and second oil output pipe form an independent oil pipe module, the first and second hydraulic plunger pumps form an independent pump module, the oil pipe module is connected with the pump module through a plug-in structure;

the plug-in structure comprises a rectangular convex structure which is provided at a connection end of the oil pipe module, a multi-pin socket is installed on the rectangular convex structure, the rectangular convex structure has two insertion holes which are interconnected with the first and second high-pressure oil output pipes respectively;

a rectangular concave structure is provided at an output end of the pump module, a multi-pin plug which matches the multi-pin socket is installed on the rectangular concave structure, two oil pipe joints are provided within the rectangular concave structure and match the two insertion holes respectively;

the oil pipe module has multiple first bolt holes at a periphery thereof, the pump module has multiple second bolt holes, which match the first bolt holes respectively at a periphery thereof.

7. The multi-pump integrated mixed fluid delivery device according to claim 4, wherein:

the first and second oil output pipes form an independent oil pipe module, the first and second hydraulic plunger pumps form an independent pump module, the oil pipe module is connected with the pump module through a screw structure;

the screw structure comprises two insertion holes, a multi-pin socket for connecting with cables, and multiple delivery ports for delivering hydraulic oil or samples, wherein the two insertion holes are provided in the oil pipe module and interconnected with the first and second oil output pipes respectively;

the multi-pin socket comprises a first multi-pin sub-socket and a second multi-pin sub-socket;

two insertion columns for matching the two insertion holes, a multi-pin plug for matching the multi-pin socket, and multiple delivery plugs for matching the multiple delivery ports respectively are provided at an output end of the pump module;

a threaded sleeve is provided at an external surface of the connection end of the oil pipe module.

8. The multi-pump integrated mixed fluid delivery device according to claim 4, wherein the second output shaft of the dual-shaft motor is connected with a reducer through a connection shaft and then is connected with the lead screw, the reducer is installed at an end portion of the piston sub-casing through a mounting base, an output shaft of the reducer is connected with an end portion of the lead screw, the connection shaft extends into the mounting base and is connected with the reducer, two support bearings are installed on one end portion of the connection shaft.

9. The multi-pump integrated mixed fluid delivery device according to claim 8, wherein a limit bearing is provided at one end of the lead screw which is connected with the reducer, a baffle ring and a disc spring are provided at one side of the limit bearing which is away from the reducer, a fixed sleeve and a lock nut are provided at another side of the limit bearing which is close to the reducer, and the lock nut is screwed on the lead screw for fixing the limit bearing.

10. The multi-pump integrated mixed fluid delivery device according to claim 8, wherein an accommodating passage for allowing the lead screw to enter is provided within the piston rod, an opening of the accommodating passage is sleeved and fixed on the screw nut, a piston which has a diameter as same as an inner diameter of the piston sub-casing is fixed at one end of the piston rod away from the screw nut, the piston divides the sample chamber into a left chamber and a right chamber.

11. The multi-pump integrated mixed fluid delivery device according to claim 10, wherein an external surface of the opening of the accommodating passage is as same as an inner diameter of the piston sub-casing, an interior of the piston sub-casing is divided into two hydraulic oil chambers.

12. The multi-pump integrated mixed fluid delivery device according to claim 11, wherein a positioning key is provided on the external surface of the opening, a feather keyway matching the positioning key is provided within the piston sub-casing, the two hydraulic oil chambers are interconnected with each other through the feather keyway.

13. The multi-pump integrated mixed fluid delivery device according to claim 10, wherein the left chamber and the right chamber are interconnected with a sample input passage which is communicated with an outside world, and a sample output passage which is communicated with the sample cylinder respectively.

14. The multi-pump integrated mixed fluid delivery device according to claim 10, wherein an isolation sleeve, which is provided in a middle portion of the piston rod, is connected with the piston sub-casing and the sample sub-casing through external threads of the isolation sleeve respectively, one end of the isolation sleeve closer to the screw nut has an inner annular groove, a metal ring which contacts the external surface of the piston rod is provided within the inner annular groove through interference fit, a movable sealing ring is provided within an inner hole which is in contact with the piston rod.

15. The multi-pump integrated mixed fluid delivery device according to claim 2, wherein the first hydraulic plunger pump and the second hydraulic plunger pump are set within the casing in parallel, the output shaft of the dual-shaft motor is connected with one of the gears through a transmission shaft.

16. The multi-pump integrated mixed fluid delivery device according to claim 15, wherein the first hydraulic plunger pump and the second hydraulic plunger pump are installed within two chambers of the casing through external threads, the two chambers are interconnected with each other and full of hydraulic oil.

17. The multi-pump integrated mixed fluid delivery device according to claim 1, wherein:

the multiple hydraulic plunger pumps comprise three hydraulic plunger pumps which are a first hydraulic plunger pump, a second hydraulic plunger pump and a third hydraulic plunger pump;

the first hydraulic plunger pump and the second hydraulic plunger pump are installed in parallel;

a third drive shaft of the third hydraulic plunger pump is opposite to a first drive shaft of the first hydraulic plunger pump;

an output end of the first hydraulic plunger pump, an output end of the second hydraulic plunger pump and an output end of the third hydraulic plunger pump are connected with a respective oil output pipe;

a second gear of the gears is installed on a second drive shaft of the second hydraulic plunger pump;

a first gear of the gears is installed on the first drive shaft of the first hydraulic plunger pump and a third gear of the gears is installed on the third drive shaft of the third hydraulic plunger pump;

the second gear is engaged with the first and third gears.

* * * * *